United States Patent [19]

Sung

[11] 4,146,761

[45] Mar. 27, 1979

[54] KEY ACTUABLE ELECTRICAL SWITCH

[76] Inventor: Ki P. Sung, 5728 W. 43rd St., Indianapolis, Ind. 46254

[21] Appl. No.: 860,632

[22] Filed: Dec. 14, 1977

Related U.S. Application Data

[63] Continuation-in-part of Ser. No. 687,540, May 18, 1976, abandoned.

[51] Int. Cl.[2] ..... H01H 27/06

[52] U.S. Cl. ..... 200/44; 70/364 A; 70/407

[58] Field of Search ..... 200/44, 61.64, 61.66; 70/360, 364 A, 407

[56] References Cited

U.S. PATENT DOCUMENTS

| | | | |
|---|---|---|---|
| 1,124,862 | 1/1915 | Clemmer et al. | 70/407 X |
| 2,910,860 | 11/1959 | Moreno Camba | 70/360 X |
| 3,270,152 | 8/1966 | Carmichael | 200/44 |
| 3,522,394 | 7/1970 | Bellrose | 200/44 |
| 3,538,725 | 11/1970 | Guenther et al. | 70/360 X |
| 3,676,617 | 7/1972 | Miller | 200/44 |
| 3,766,341 | 10/1973 | Guenther et al. | 200/44 |

*Primary Examiner*—Herbert F. Ross
*Attorney, Agent, or Firm*—Jenkins, Coffey, Hyland, Badger & Conard

[57] ABSTRACT

A key-actuable electrical switch for a key having a distal end portion including a hook and an abutment section, a central portion including key cuts defining a tumbler pin code and a proximal end shank portion. The switch includes a housing having a first portion rotatably receiving a key core including a plurality of tumbler pins, the first portion including a set of tumbler pin retraction bores housing springs for urging the tumbler pins into engagement with the tumbler pin code portion of the key. The key cooperates with the key core, tumbler pins and retraction bores to permit sliding movement of the key longitudinally of the core in the locked position and in at least one other switch actuating position. The switch includes a first pair of circuit terminals and a movable contact carrier having a first position opening a circuit between the first pair of circuit terminals and a second position closing the circuit between the first pair of circuit terminals. The switch also includes a sliding actuator mechanism actuated by longitudinal movement of the key, and a race for slidably mounting the actuator mechanism within the switch housing. A connector assembly couples the actuator mechanism to the movable contact carrier. Sliding movement of the actuator mechanism moves the contact carrier to the second position to close the circuit between the first pair of terminals.

15 Claims, 6 Drawing Figures

KEY ACTUABLE ELECTRICAL SWITCH

This application is a continuation-in-part of my copending U.S. patent application Ser. No. 687,540, filed May 18, 1976, now abandoned.

This invention relates generally to key-actuable electrical switches. This invention is particularly applicable to combined automobile ignition and light switches.

Various types of combined automobile ignition and light switches which prevent opening of the ignition circuits of automobiles until after the lights of the automobile have been turned off have been proposed. For example, there are the systems of U.S. Pat. No. 3,270,152 and U.S. Pat. No. 3,522,394. These systems, as well as many other, are all key-actuated, depending as they do upon placement of the ignition key into the automobile or other vehicle ignition to close the automobile driving lamp circuits and maintain such circuits in a closed condition.

In this regard, the automobile ignition key can be thought of as containing an amount of "coded" information, the code of the information contained on the key determining whether or not the automobile ignition circuit, starting circuit, accessory circuits, driving lamp circuits and so forth can be energized. The code contained on the automobile key is, of course, determined by the profile of the key when viewed in side and end elevations. On many automobile ignition keys, key cuts providing the serrated or "code" profile are made from one longitudinal edge only of the key. Thus, there is considerable space remaining on the key to "encode" additional information. For example, in a typical automobile ignition key, one entire longitudinal edge of the key contains no coded information. Neither does the end edge of the key which is inserted into the ignition lock core.

It is a general object of this invention to make further use of the ignition key, by encoding additional information on the key, and utilizing this additional encoded information to operate various vehicle electrical systems in addition to the conventional ignition circuit, starting circuit, accessory electrical circuits, etc.

It is a further object of this invention to use this additional encoded information on the ignition key to control, for example, the function of the driving lamps, i.e., head lamps, tail lamps and parking lamps, of the vehicle.

According to the invention, a key-actuable electrical switch is provided for a key having a distal end portion including hook and abutment means, a central portion including key cuts defining a tumbler pin code, and a proximal shank portion. The switch includes a switch housing having a first portion rotatably receiving a key core including a plurality of tumbler pins, the first portion including means defining at least a first set of tumbler pin retraction bores. The key cooperates with the key core, tumbler pins and retraction bores to permit sliding movement of the key longitudinally of the key core in the locked position and at least one other switch actuating position. The switch includes at least a first pair of circuit terminals and a movable contact carrier having a first position opening a circuit between the first pair of circuit terminals and a second position closing the circuit between the first pair of circuit terminals. The switch also includes a sliding actuator mechanism actuated by longitudinal movement of the key, and a race for slidably mounting the actuator mechanism within the switch housing. Means are provided for connecting the actuator mechanism to the movable contact carrier. Sliding movement of the actuator mechanism moves the contact carrier from the first position to the second to close the circuit between the first pair of terminals.

According to an illustrative embodiment, the switch further includes a pair of second circuit terminals, the movable contact carrier having a third position closing the circuit between the terminals of the second circuit. In the illustrative embodiment, a vehicle ignition switch including means for operating the vehicle driving lamps, the circuit between the terminals of the second pair is open when the movable contact carrier is in the first position and the circuit between the first pair of terminals is closed when the movable contact carrier is in the third position. The circuit between the terminals of the second pair is a part of the vehicle head lamp/tail lamp circuit, and the circuit between the terminals of the first pair is a portion of the vehicle parking lamp circuit.

Additionally, according to an illustrative embodiment, the first electrical switch further includes means for engaging the hook on the distal end of the key, the hook engagement means being actuable by movement of the actuator mechanism as the movable contact carrier of the electrical switch is moved from the first position to engage the hook and thereby prevent removal of the key from the lock without returning the contact carrier to the first position to open the circuit between the terminals of the first pair. In the vehicle embodiment illustrated, this feature prevents removal of the key from the lock without opening the driving lamp (i.e., head lamp, tail lamp and parking lamp) electrical circuits.

Further according to the illustrative embodiment, the hook engaging means includes a lever having a first end defining a portion for engaging the hook and a second end, the lever being pivotally mounted on the actuator mechanism between the lever's first and second ends, means for urging the first end of the lever into engagement with the hook, and a fulcrum positioned in the switch housing to remain substantially stationary with respect to the actuator mechanism and lever as the actuator mechanism and lever are moved along the race by movement of the key longitudinally in the core. Movement of the lever with respect to the fulcrum causes the lever pivot to move from one side of the fulcrum to the other, thereby rocking the first end of the lever into engagement with the key hook as the key is moved longitudinally into the core, and out of engagement with the key hook as the key is moved longitudinally out of the core.

Further according to an illustrative embodiment, means are provided for preventing removal of the key from the key core while the key core is in the switch actuating position, such means further permitting restricted longitudinal sliding movement of the key in the core to actuate the switch. In the illustrative vehicle embodiment, this means that the key can be moved longitudinally in the core a restricted amount to actuate either the parking lamps or all of the driving lamps with the key in the vehicle ignition "on" position, but the key cannot be removed completely from the core while it is in the vehicle ignition "on" position.

In the illustrative embodiment, the key removal prevention means comprises a key cut defining an additional tumbler pin code portion on the opposite edge of the key from the first-mentioned tumbler pin code portions, and an additional tumbler pin slidably mounted in the core for movement generally transversely of the longitudinal extent of the core. The pin is urged into engagement with the additional code portion of the key when the core is in the locked position. However, the tumbler pin is blocked against retraction from the additional code portion when the core is in the switch-actuating position (in the vehicle embodiment, the ignition "on" position). In the illustrative embodiment, the additional code portion extends longitudinally along the key edge a distance to permit longitudinal sliding key movement in the core a sufficient distance to move the contact carrier from the first position to the second and/or third position(s).

In the illustrative embodiment, the first portion of the switch housing further includes means defining a second set of tumbler pin retraction bores to permit retraction of at least selected ones of the tumbler pins when the key core is in the switch actuating position, thereby permitting the necessary sliding movement of the key longitudinally in the core. Alternatively, of course, each tumbler pin code segment of the key could extend along the key edge longitudinally a distance equal to the distance the key must necessarily move longitudinally of the core to move the movable contact carrier from the first position to the second and/or third position(s). This, of course, is somewhat less desirable, since it would require the key and core to be substantially longer than they conventionally are now.

Further according to an illustrative embodiment, the apparatus comprises rotary switch means including a movable contact and at least one stationary contact, the movable contact of the rotary switch means being coupled to one terminal of a third circuit and the stationary contact being coupled to another terminal of the third circuit. Closure of the rotary switch contacts closes a circuit between the third terminals. The movable contact of the rotary switch is coupled to the key core for rotation thereby. The rotary switch means is housed in the switch housing. Such apparatus may also include a stationary contact defining with the movable contact of the rotary switch, a pair of terminals of a fourth circuit, the movable contact of the rotary switch having a first position opening both the third and fourth circuits, a second position closing the third circuit and opening the fourth, and a third position closing both the third and fourth circuits between their respective pairs of terminals. The rotary switch means further includes means for urging the movable contact thereof from the third position to the second. As a further desirable feature of such an arrangement, the rotary switch means may include a stationary contact defining with the movable contact of the rotary switch means a pair of terminals of a fifth circuit, the movable contact of the rotary switch having a fourth position closing the circuit between the fifth pairs of terminals. This last briefly described embodiment is the illustrative embodiment in which the electrical switch is a vehicle driving lamp switch and the rotary switch means comprises the vehicle ignition switch. The locked position of the key core corresponds to the locked position of the vehicle ignition and the first position of the movable contact of the rotary switch. The switch actuating position of the key core and second position of the movable contact of the rotary switch correspond to the ignition "on" or "run" position of the ignition switch. The third position of the movable contact with the rotary switch corresponds to the "start" position of the ignition switch. Finally, the fourth position of the movable contact of the rotary switch corresponds to the "accessory" position of the ignition switch, permitting use of other electrical circuits in the vehicle. The rotary switch could, further, have positions corresponding to other positions of the conventional ignition switch. In this embodiment, of course, means are provided for electrically insulating the movable contact of the rotary switch from the key.

Desirably, pawl means are coupled to the movable contact of the rotary switch and detent plate means are provided in the rotary switch for engagement by the pawl means to hold the movable contact of the rotary switch in one of the first, second or fourth positions. The second position of the movable contact of the rotary switch corresponds, of course, to the switch-actuating position of the key core.

The invention may best be understood by referring to the following description and accompanying drawings which illustrate the invention. In the drawings.

Figures 1, 2:
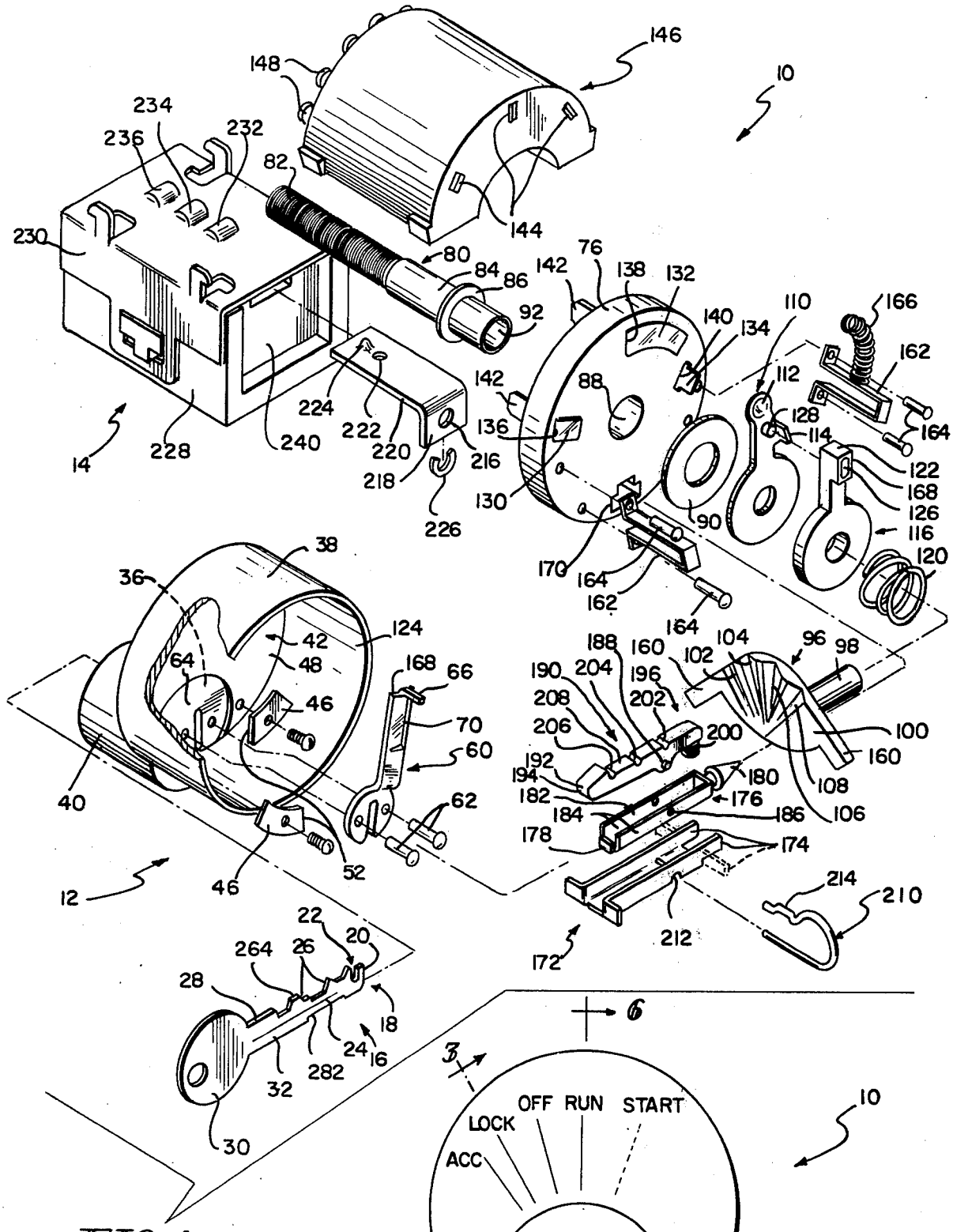
FIG. 1 is an exploded perspective view of a device constructed according to the present invention.
FIG. 2 is an end elevational view of the device of FIG. 1.
Figure 3:
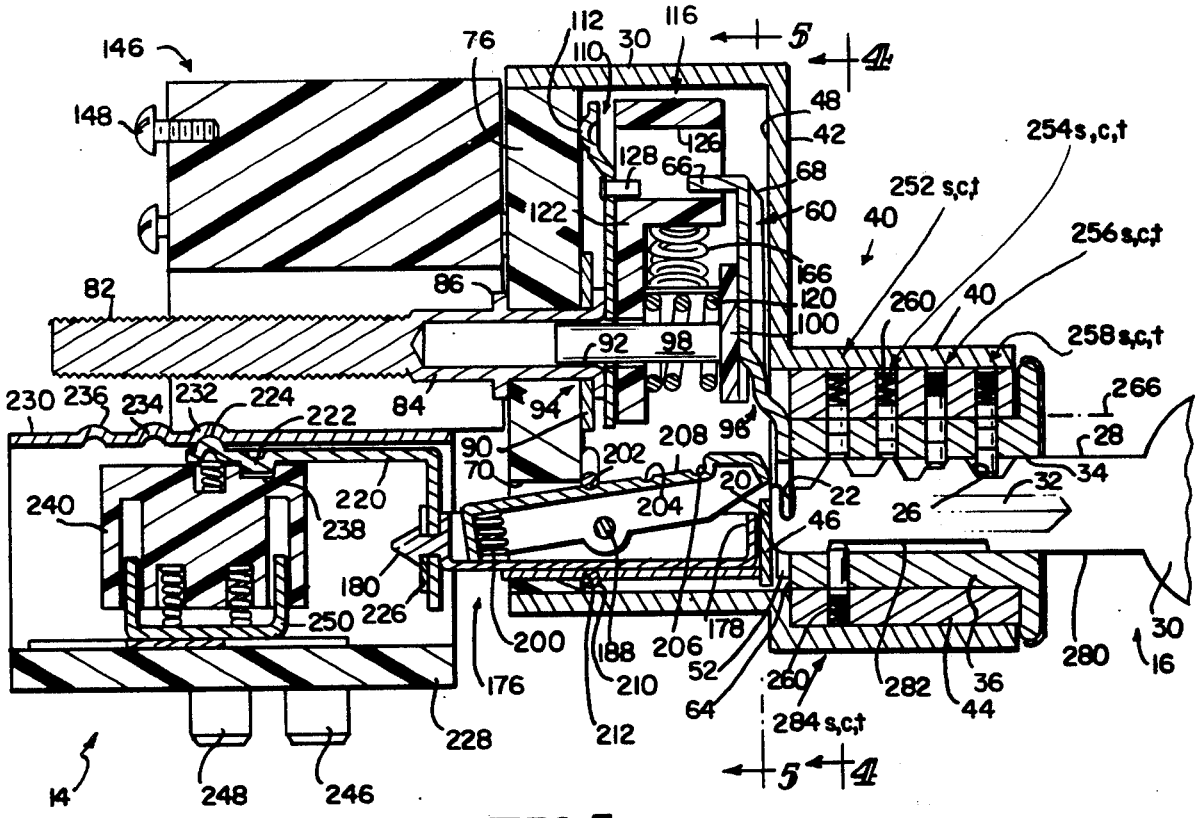
FIG. 3 is a sectional side elevational view of the device of FIGS. 1–2, taken generally along section lines 3—3 of FIG. 2.
Figure 4:
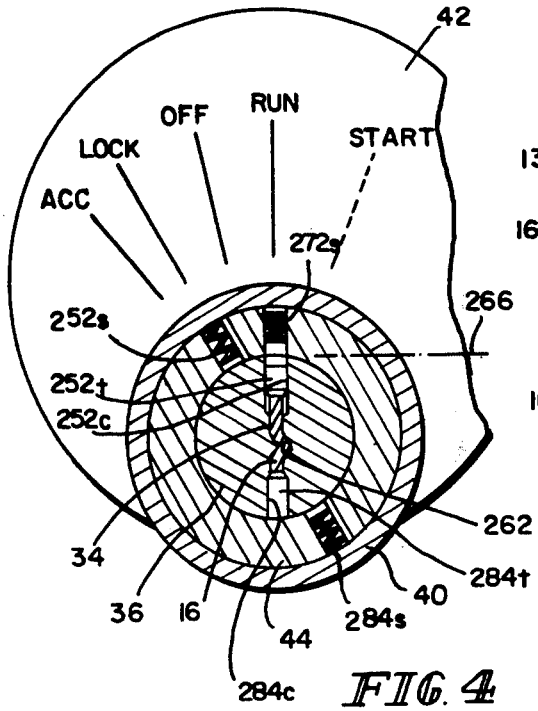
FIG. 4 is a fragmentary sectional view of the device of FIGS. 1–3, taken generally along section lines 4—4 of FIG. 3.
Figure 5:
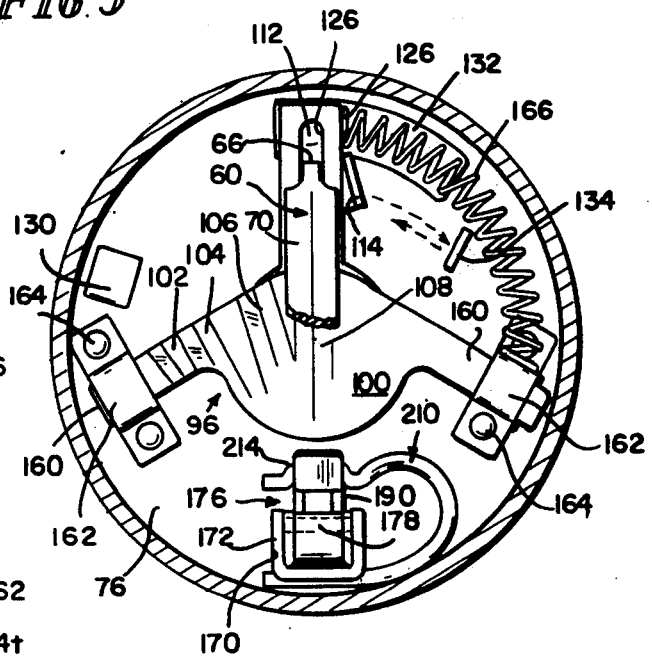
FIG. 5 is a fragmentary sectional view of the device of FIGS. 1–4, taken generally along section lines 5—5 of FIG. 3.
Figure 6:
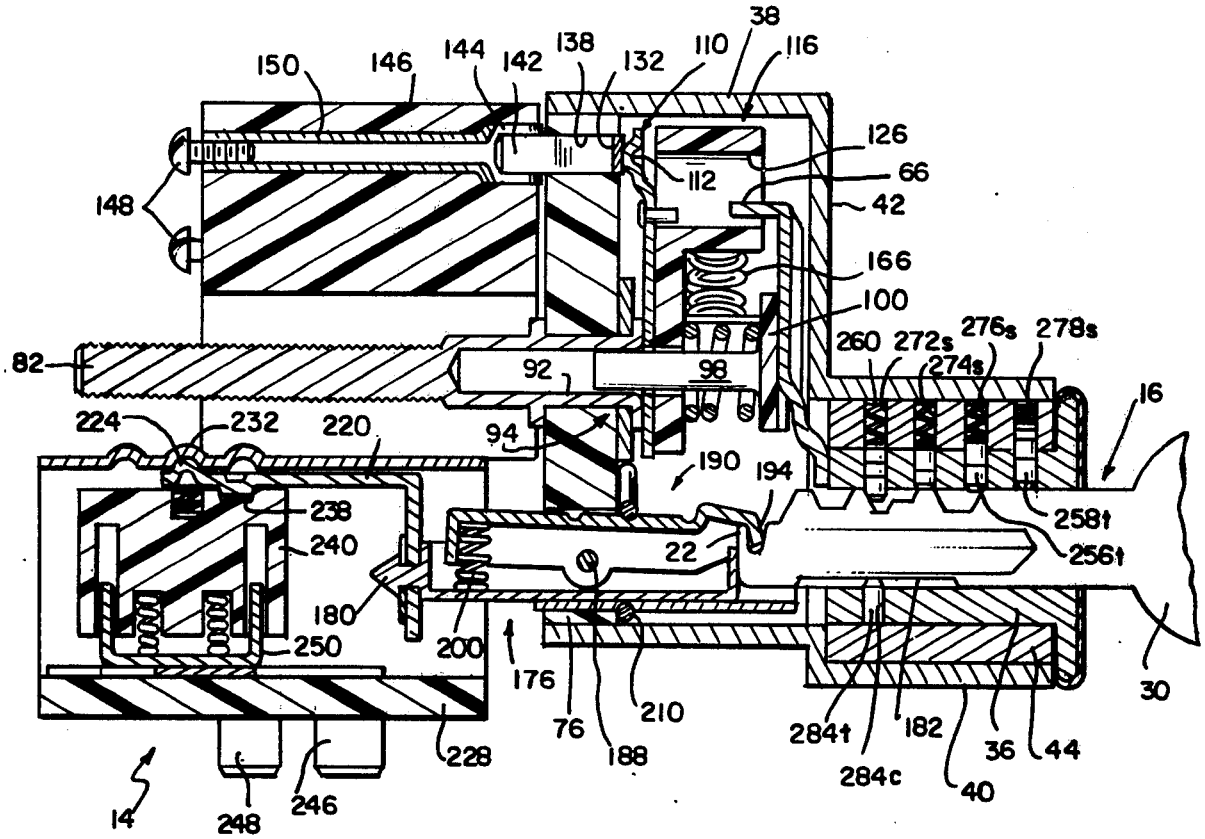
FIG. 6 is a sectional side elevational view of the device of FIGS. 1–5, taken generally along section lines 6—6 of FIG. 2.

Referring now to the drawings, and particularly to FIGS. 1 and 2, the apparatus of the present invention is incorporated into an automobile ignition switch and driving lamp switch 10 in combination. As can best be appreciated from FIGS. 3 and 6, the illustrative assembly 10 can be thought of as having a vehicle ignition switch component 12 and a driving lamp component 14. The components 12, 14 of switch assembly 10 are designed to be actuated by a key 16 having a distal end portion 18 including a generally flat abutment edge or surface 20 and a hook or notch 22, a central portion 24 of essentially conventional configuration including key cuts 26 defining a tumbler pin code section, a proximal end shank portion 28 of slightly longer length than a conventional key, and a key head 30 of substantially conventional configuration. As best illustrated in FIGS. 3, 6, the key 16 is provided with conventional side grooves 32 extending longitudinally of the key and shaped to conform to the profile of the key slot opening 34 in a key-actuable core 36, best seen in FIGS. 1, 4.

Returning now to the switch assembly 10, the vehicle ignition switch component 12 thereof is provided within the generally right circular cylindrical switch housing 38 in the outer end of which is formed a generally right circular cylindrical core and sleeve housing 40. As best seen in FIG. 1, core and sleeve housing 40 communicates, at its interior end 42 with switch housing 38. Core and sleeve housing 40 houses a sleeve 44 nonrotatably. Sleeve 44, in turn, coaxially and rotatably supports the core 36. Core 36 is, of course, held against axial movement with respect to sleeve 44 by any of a number of known means. As best illustrated in FIGS. 1, 3 and 6, the distal end portion 18 of the key 16 thereby is insertable through the key slot opening 34 in core 36 and through the interior end 42 of the core and sleeve housing 40 into the switch housing 38. A pair of stops 46 are riveted, welded, screwed or otherwise attached to the inner end wall 48 of switch housing 38 to provide stop surfaces 50 with a slot-shaped space 52 defined therebetween. The width of space 52 is slightly larger than the thickness of key 16 to permit the distal end portion 18 of key 16 to be inserted through space 52 in only one position of the core 36. A rotary switch actuator arm 60 is attached, as by rivets 62, to the exposed inner end 64 of core 36. Arm 60 is actuated by rotation of core 36. Arm 60 provides a finger-like projection 66 which extends at generally right angles to its distal end 68. Arm 60 further provides a pawl-like surface 70 on its side opposite inner end wall 48.

Switch housing 38 also includes a generally disk-shaped inner end wall 76 which, in the illustrative embodiment, is constructed from an insulative material, e.g., DELRIN. The inner end wall 76 may be secured in the switch housing 38 by any of a number of well-known means, e.g., screws, adhesive, etc. Many of the remaining elements of the illustrative switch structure are supported from inner end wall 76 to simplify the construction and final assembly of the switch assembly 10.

A stud 80 having a threaded portion 82 and an unthreaded portion 84 with a flange 86 positioned thereon is located in a central circular passageway 88 through wall 76. The unthreaded portion 84 is inserted into passageway 88 until the flange 86 abuts the wall 76. A washer is placed over the unthreaded end 84 which projects through passageway 88 to the interior side of wall 76 and the hollow inner end 92 of stud 80 is formed over washer 90 as best illustrated at 94 in FIGS. 3, 6. A detent 96 includes a stem 98 which is slidably inserted into the hollow inner end 92 of stud 80. Detent 96 also includes a head 100 which, as best illustrated in FIG. 1, contains a plurality of grooves 102, 104, 106, 108, defining four positions.

The automobile ignition switch component 12 of assembly 10 further includes a movable contact arm 110 mounted on stem 98 and captured between the face 100 of detent 96 and washer 90. Contact arm 110 includes a movable contact 112 defined at the distal end thereof, and a movable contact 114 defined along the right lateral edge thereof, as viewed in FIG. 1. An insulating coupler 116 is mounted upon stem 98 between movable contact arm 110 and head 100 of detent 96. The coupler arm 116 and movable contact arm 110 are urged rearwardly of housing 38 against the formed portion 94 of stud 80 by a compression spring 120 which is captured between the detent head 100 and the coupler 116 on stem 98. Coupler 116 includes an arm 122 which extends generally radially of the stem 98 toward the side wall 124 of switch housing 38 and is provided at its radially outer extent with an elongated radially and axially extending slot 126. The movable contact arm 110 and coupler 116 are urged together. The movable contact arm 110 is provided at its radially outer extent adjacent movable contacts 112, 114, a projection or finger 128 which projects toward end 42 of switch housing 38 into the end of slot 126. In the illustrative embodiment, this projection 128 is provided by a small rivet through movable contact arm 110. The engagement of projection 128 in slot 126 insures that the movable contact arm 110 will move with the coupler 116.

Movement of coupler 116 is provided by the engagement of projection 66 of rotary switch actuator arm 60 into slot 126 from the end 42 of housing 38. The pawl surface 70 of rotary switch actuator arm 60 engages in one of grooves 102, 104, 106, 108 of the detent face 100 which is spring 120 urged against pawl surface 70. It will be appreciated that rotation of core 36 permitted by insertion of the proper key 16 will pivot the movable contact arm 110 about the axis of stem 98. Accessory, run and start terminals 130, 132, 134, respectively are press-fitted into longitudinally extending slots 136, 138, 140, respectively, provided in inner end wall 76. The outer ends of these terminals project through inner end wall 76 to provide tabs 142 which are received in sockets 144 in a plug-in terminal block 146. A plurality of screw-type connectors 148 are provided at the other end of plug-in terminal block 146 to permit access to the various terminals 130, 132, 134 from several circuits within the vehicle. The plug-in terminal block 146 may be molded or otherwise formed from an insulative material and, of course, conductors 150, best illustrated in FIGS. 3, 6 are molded into plug-in terminal block 146 or otherwise provided therethrough to establish continuity between connectors 148 and sockets 144.

To aid in the assembly of the various components to inner end wall 76, detent head 100 is provided with a pair of arms 160 which are slidably engaged under a pair of upstanding brackets 162. During the assembly of the various components to inner end wall 76, brackets 162 are attached to wall 76 by rivets 164. A start return spring 166 is attached, as by welding, to the upper side of the right bracket 162 as illustrated in FIG. 1. Spring 166 is a compression spring and conforms to the curvature of side wall 124 such that it lies in the path of the enlarged distal end portion 168 of coupler arm 116 providing slot 126. As the key core 36 is turned toward the "start" position of the ignition, spring 166 is compressed by its engagement with the distal end portion 168 of arm 116. After the vehicle engine is started, the operator releases the key head 30. Spring 166 causes the movable contact arm 110 to recoil out of engagement with the start terminal 134, with which it was in engagement during the start interval. Contact 112, of course, must remain in engagement with the run terminal 132 of ignition switch component 12. Thus, start return spring 66 is not sufficiently strong to carry contact 112 past run contact 132.

Turning now to the driving lamp switch component 14 of assembly 10, an axially extending, somewhat T-shaped slot 170 is provided in inner end wall 76 near the periphery thereof, as best illustrated in FIG. 1. A race of slideway 172 which is somewhat channel-shaped and rectangular in cross section is inserted into T-shaped slot 170 from the switch housing 38 inner side of wall 76 and is held therein by forming over a pair of ears 174 of the race 172 from the positions illustrated in solid lines in FIG. 1 to the positions illustrated in broken lines in FIG. 1. An actuator member 176 which is molded from a wear-resistant material is slidably mounted in race 172. As best seen in FIGS. 1, 3, 6, actuator member 176 includes an abutment 178 at one end thereof, and a generally conical coupler 180 at the other end thereof. Actuator member 176 includes an open central region 182 between two longitudinally extending side walls 184 thereof. Each side wall 184 is provided with a hole 186 for receiving a pivot pin 188.

A lever 190 has a first end 192 including a wall portion 194 for engaging the hook portion 22 on the distal end 18 of key 16, and a second end 196. Lever 190 is pivotally mounted upon pin 188 which is received through a bore 198 between the first and second ends 192, 196 of lever 190. A compression spring 200 for urging the second end 196 of lever 190 upwardly away from actuator member 176 is mounted on the under side of second end 196. Compression spring 200 thus urges the wall portion 194 of lever 190 downwardly into engagement with the hook 22 on key 16.

Three detent-type grooves 202, 204, 206, are formed in the top surface 208 of lever 190. A spring clip 210 extends into a groove 212 provided in the bottom surface of race 172. The spring clip 210 also surrounds the assembled actuator member 176 and lever 190. One purpose of the spring clip 210 is best illustrated in FIGS. 3, 6, that purpose being to prevent longitudinal movement of the race 172 after its assembly into the T-shaped slot 170 in end wall 76. A further purpose of clip 210 is to provide a fulcrum which remains substantially stationary with respect to actuator member 176 and lever 190 as these components slide longitudinally within race 172 in a manner to be described.

Movement of actuator member 176 and lever 190 with respect to the fulcrum provided by the upper arm 214 of spring clip 210 will cause pivot pin 188 effectively to move from one side of the fulcrum provided by upper arm 214 to the other side thereof to rock the first end 192 of lever 190 about pivot 188. As best seen by comparing FIGS. 3 and 6, rocking of the lever 190 about pivot pin 188 causes the wall portion 194 on the first end 192 of lever 190 to engage the hook 22 of the distal end portion 18 of key 16. It will be appreciated that this engagement of hook portions 22, 194 prevents relative movement between the key 16 and actuator member 176 until hook portions 22, 194 are disengaged from one another.

The coupler 180 on actuator member 176 extends through inner end wall 76 and through an aperture 216 provided in a tab 218 on the end of a driving lamp switch actuator bracket 220. Actuator bracket 220 is provided with a boss 222 protruding from the under side thereof and a boss 224 protruding from the upper side thereof. Coupler 180 is held in aperture 216 by a C-ring 226. Bracket 220 extends into a driving lamp switch terminal housing 228 including a cover 230, which is desirably constructed from metal and includes three reliefs 232, 234, 236 stamped on the inside thereof. The reliefs 232, 234, 236 are spaced apart a distance on centers substantially equal to the on-centers spacing of detent grooves 202, 204, 206, respectively, in the top surface 208 of lever 190. Reliefs 232, 234, 236 are proportioned and designed for engagement by boss 224. Boss 222 engages a relief 238 formed on a movable contact carrier 240 which is slidable within the driving lamp switch terminal housing 228 longitudinally of actuator member 176.

Driving lamp switch mechanism 14 further includes a plurality of terminals 242, 244, 246, 248, best seen in FIGS. 2, 3, 6. Terminals 242, 244 comprise a first pair of terminals for the vehicle parking lamp circuits. Terminals 246, 248 comprise a second pair of terminals for the vehicle head lamp and tail lamp circuits. While four terminals 242, 244, 246, 248 are illustrated, it is understood that it may be desirable to provide only three such terminals, one of the three terminals serving as a common terminal for both the parking lamp circuits, and the head lamp and tail lamp circuits. In the illustrative embodiment, the terminals 242, 244, 246, 248 are so arranged in driving lamp switch terminal housing 228 that the spring-loaded movable contacts 250 supported upon the movable contact carrier 240 (see FIGS. 3, 6) first engage terminals 242, 244 as the sliding actuator member 176 and movable contact carrier 240 are moved from right to left as seen in FIGS. 3, 6. Thus, movement of actuator 176 and movable contact carrier 240 toward the left from a first position opening the parking lamp circuit between terminals 242, 244 toward a second position closing the circuit between terminals 242, 244 first energizes the parking lamps. Further movement of actuator 176 and movable contact carrier 240 toward the left causes movable contacts 250 on carrier 240 to close the circuit between the second pair of terminals 246, 248 while maintaining the closed condition of the circuit between terminals 242, 244. Thus, in a third position of actuator member 176 and movable contact carrier 240, both the parking lamp circuits and the head- and tail lamp circuits are closed.

Turning now to the key core 36 and key sleeve 44 assembly which permits actuation of the driving lamp switch component 14, and with reference specifically to FIG. 3, there is illustrated a series of aligned tumbler pin bores in the core 36 in sleeve 44. The sleeve bores are designated by presence of a "s" in their reference numerals. The core bores are designated by the presence of a "c" in their reference numerals. The sleeve tumbler pin bores are 252*s*, 254*s*, 256*s*, 258*s*. The core tumbler pin bores are 252*c*, 254*c*, 258*c*. Each pair of mating bores slidably receives a stack of one or more tumbler pin sections 252*t*, 254*t*, 256*t*, 258*t*. Each of sleeve bores 252*s*, 254*s*, 256*s*, 258*s* also includes a compression spring 260 biasing its respective column of tumbler pin sections 252*t*, 254*t*, 256*t*, 258*t* downward into the key slot 34. The side walls 262 of the key slot 34 include stops (not shown) which prevent the loss of tumbler pin sections from columns 252*t*, 254*t*, 256*t*, 258*t* into the key slot 34, in accordance with known tumbler lock core design. The core 36 position illustrated in FIG. 3 is the "lock" position of the vehicle ignition. When the key 16 is inserted into key slot 34 with the core 36 in this position, the key cuts 26 along the upper edge 264 of key 16 align the tumbler pins of the columns 252*t*, 254*t*, 258*t* such that these columns can be separated at the shear line 266 between the core 36 and sleeve 44. In this position, the longitudinal insertion of the key 16 into the slot 34 is stopped by the stops 46 against which abutment portion 20 of the key 16 is located.

With the tumbler pin columns in the positions illustrated in FIG. 3, the key 16 is capable of turning the core 36 to the "accessory" position, the "off", the "run" position or the "start" position, all illustrated in FIG. 2. Assuming now that the vehicle is to be started, the key 16 is turned to rotate the core 36 to bring contacts 112, 114 of arm 110 contact with their respective stationary contacts 132, 134 on wall 76. As the vehicle engine is started, the operator releases key head 30 causing start return spring 166 to break contact 114 from start contact 134. Contact 112 remains engaged with contact 132.

With the ignition in this position, illustrated in FIG. 6, key 16 is so oriented that the distal end portion 18 thereof is aligned with the slot-shaped space 52 between stops 46. An addition set of sleeve tumbler pin bores 272*s*, 274*s*, 276*s*, 278*s* lies in alignment with respective core tumbler pin bores 252*c*, 254*c*, 256*c*, 258*c*. Compression springs 260 are fitted in these additional sleeve tumbler pin bores 272*s*, 274*s*, 276*s*, 278*s*, as illustrated in FIG. 6. The tumbler pins of the various columns 252t, 254t, 256t, 258t which are captured in bores 252c, 254c. 256, 258c as core 36 is rotated from the "lock" position are thus permitted to be retracted from these core tumbler pin bores into the second set of sleeve tumbler pin bores 272s, 274s, 276s, 278s with the key and ignition in the "run" position. This permits the key 16 to slide longitudinally of the key slot 34 in the "run" position.

However, it is necessary to prevent complete disengagement of the key 16 from the slot 34 to prevent removal of the key 16 from the ignition while the vehicle is running. To this end, there is provided on the bottom edge 280 of key 16 an additional key cut 282 having a length equal to the longitudinal distance key 16 is to be permitted to move in slot 34 with the ignition in the "run" position. With reference to FIG. 3, there is provided an additional sleeve tumbler pin bore 284s and a mating core tumbler pin bore 284c. A tumbler pin 284t, or column of tumbler pin sections, is spring urged into engagement with the core section provided by key cut 282 by a compression spring 260 housed in sleeve tumbler pin bore 284s. As best illustrated in FIG. 6, no mating sleeve tumbler pin bore is provided for the core tumbler pin bore 284c when the key core 36 is in the ignition "run" position. This inhibits retraction of the tumbler pin 284t or column of tumbler pins with the ignition in this position. Thus, the tumbler pin or column of tumbler pins 284t prevents longitudinal movement of the key 16 in key slot opening 34 beyond the limits of key cut 282. This feature prevents complete removal of the key 16 from the core 36 when the ignition switch is in the "run" position.

Key cut 282 does permit some longitudinal movement of key 16 through space 52 and into engagement with actuator member 176. Specifically, the elongated shank position 28 of key 16 permits the key abutment region 20 to be moved into engagement with the abutment 178 on actuator member 176. This engagement, and continued longitudinal movement of key 16 into slot 34, will move actuator member 176 from its first position illustrated in FIG. 3, in which all of the driving lamps are off, to the second position in which the upper arm 214 of spring clip 210 engages detent groove 204 of lever 190, rocking the lever 190 about pivot pin 188 and causing the wall portion 194 of lever 190 to engage the hook 22 at the distal end 18 of key 16. This movement by actuator member 176 also moves the movable contact carrier 240 to close the parking lamp circuit between terminals 242, 244 energizing the parking lamps of the vehicle. Continued inward movement of key 16 in slot 34 closes the circuit between terminals 246, 248, energizing the head- and tail lamps of the vehicle, as the actuator member 176 and lever 190 pivotally supported thereon are moved to a third position in which upper arm 214 of spring clip 210 is engaged in detent groove 206 on the top surface of lever 190. This position corresponds to the outermost end of the key code portion defined by key cut 282. Thus, further inward movement of key 16 in slot 34 is prevented. This is the position of the various elements illustrated in FIG. 6. It will be appreciated that the engagement of wall portion 194 and hook 22 causes the circuits between terminals 246, 248 and terminals 242, 244 to be opened serially as key 16 is withdrawn from the slot 34 toward its position illustrated in FIG. 3.

What is claimed is:

1. A key actuable electrical switch and a key having a distal end portion including means for providing a hook and means for providing an abutment, a central portion including key cuts defining a tumbler pin code, and a proximal end shank portion, the switch including a switch housing having a first portion rotatably receiving a key core including a plurality of tumbler pins, the first portion including means defining first and second tumbler pin retraction bores, the key cooperating with the key core, tumbler pins, and first and second retraction bores, respectively, to permit sliding movement of the key longitudinally of the key core in the lock position and another position, respectively, the switch including at least a first pair of circuit terminals and a movable contact carrier having a first position opening a circuit between the first pair of circuit terminals, and a second position closing the circuit between the first pair of circuit terminals, the switch further including a sliding actuator mechanism movable in response to longitudinal movement of the key in the core, and a race for slidably mounting the actuator mechanism with the switch housing, and means for connecting the actuator mechanism to the movable contact carrier, sliding movement of the actuator mechanism moving the contact carrier to the second position to close the circuit between the first pair of terminals.

2. The apparatus of claim 1 wherein the switch further includes a pair of second circuit terminals, the movable contact carrier having a third position closing the circuit between the terminals of the second circuit.

3. The apparatus of claim 2 wherein the circuit between the terminals of the second pair is open when the movable contact carrier is in the first and second positions.

4. The apparatus of claim 3 wherein the circuit between the first pair of terminals is closed when the movable contact carrier is in the third position.

5. The apparatus of claim 1 wherein the switch further includes means for engaging the hook on the distal end of the key, the hook engagement means being actuable by movement of the actuator mechanism as the movable contact carrier of the switch is moved from the first position to engage the hook to prevent removal of the key from the lock without returning the contact carrier to the first position to open the circuit between the terminals of the first pair.

6. The apparatus of claim 5 wherein the hook engaging means includes a lever having a first end defining a portion for engaging the hook and a second end, the lever being pivotally mounted on the actuator mechanism between its first and second ends, means for urging the first end of the lever into engagement with the hook, and a fulcrum positioned in the switch housing to remain substantially stationary with respect to the actuator mechanism and lever as they are moved along the race by movement of the key longitudinally of the core, movement of the lever with respect to the fulcrum causing the lever pivot to move from one side of the fulcrum to the other to rock the first end of the lever into engagement with the key hook as the key is moved longitudinally into the core, and out of engagement with the key hook as the key is moved longitudinally out of the core.

7. The apparatus of claim 1 and further including means for preventing removal of the key from the key core while the key core is in said other position, while permitting restricted longitudinal sliding movement of the key in the core to actuate the switch.

8. The apparatus of claim 7 wherein the key removal prevention means comprises a key cut defining an additional tumbler pin code portion on the key, an additional tumbler pin slidably mounted in the core for movement generally transversely of the longitudinal extent of the core, the pin being urged into engagement with the additional code portion of the key when the core is in the lock position but blocked against retraction from the additional code portion when the core is in said other position.

9. The apparatus of claim 8 wherein the additional code portion extends longitudinally along the key edge to permit longitudinal sliding key movement in the core a sufficient distance to move the contact carrier from the first position to the second.

10. The apparatus of claim 1 and further comprising rotary switch means including a movable contact and at least one stationary contact, the movable contact of the rotary switch being coupled to one terminal of a third circuit and the stationary contact being coupled to another terminal of the third circuit, closing of the rotary switch contacts closing the circuit between the third terminals, the movable contact being coupled to the key core rotation thereby, the rotary switch means being housed in the switch housing.

11. The apparatus of claim 10 and further comprising a stationary contact defining with the movable contact of the rotary switch a pair of terminals of a fourth circuit, the movable contact of the rotary switch having a first position opening both the third and fourth circuits, a second position closing the third circuit and opening the fourth, and a third position closing both the third and fourth circuits between their respective pairs of terminals, the rotary switch means including means for urging the movable contact from the third position to the second.

12. The apparatus of claim 11 and further comprising a stationary contact defining with the movable contact of the rotary switch means a pair of terminals of a fifth circuit, the movable contact of the rotary switch having a fourth position closing the circuit between the fifth pair of terminals.

13. The apparatus of claim 12 and further comprising pawl means coupled to the movable contact and detent plate means for engagement by the pawl means to hold the movable contact in one of the first, second or fourth positions, the second position of the movable contact of the rotary switch corresponding to said other position of the key core.

14. The apparatus of claim 13 wherein the electrical switch is a vehicle driving lamp switch and the rotary switch means comprises the vehicle ignition switch, the locked position of the key core corresponding to the locked position of the vehicle ignition and the first position of the movable contact of the rotary switch, said other position of the key core and second position of the movable contact of the rotary switch corresponding to the ignition "on" or "run" position of the ignition switch, the third position of the movable contact of the rotary switch corresponding to the "start" position of the ignition switch and the fourth position of the movable contact of the rotary switch corresponding to the "accessory" position of the ignition switch.

15. The apparatus of claim 14 including means for electrically insulating the movable contact of the rotary switch from the key.

* * * * *

UNITED STATES PATENT OFFICE

CERTIFICATE OF CORRECTION

Patent No. 4,146,761 Dated March 27, 1979

Inventor(s) Ki P. Sung

It is certified that error appears in the above-identified patent and that said Letters Patent are hereby corrected as shown below:

Column 6, line 51, change "of" to --or--.

Column 7, line 28, after "pivot" insert --pin--.

Column 8, line 43, after "254t," insert --256t,--;

line 55, after "110" insert --into--.

line 64, change "addition" to --additional--.

Column 9, line 20, change "core" to --code--.

Signed and Sealed this

*Eleventh* Day of *September 1979*

[SEAL]

*Attest:*

*Attesting Officer*

LUTRELLE F. PARKER

*Acting Commissioner of Patents and Trademarks*